US006814847B1

(12) United States Patent
Cutmore et al.

(10) Patent No.: US 6,814,847 B1
(45) Date of Patent: Nov. 9, 2004

(54) METHOD AND APPARATUS FOR ELECTRO-DEPOSITION OF METAL

(75) Inventors: John Cutmore, Cooroy (AU); David Bailey, Annandale (AU)

(73) Assignee: Copper Refineries Pty Ltd, Stuart (AU)

( * ) Notice: Subject to any disclaimer, the term of this patent is extended or adjusted under 35 U.S.C. 154(b) by 0 days.

(21) Appl. No.: 10/009,895

(22) PCT Filed: Jun. 16, 2000

(86) PCT No.: PCT/AU00/00670

§ 371 (c)(1),
(2), (4) Date: Jul. 8, 2002

(87) PCT Pub. No.: WO00/79029

PCT Pub. Date: Dec. 28, 2000

(30) Foreign Application Priority Data

Jun. 18, 1999 (AU) ..... PQ 1067

(51) Int. Cl.[7] ..... C25D 1/00

(52) U.S. Cl. ..... 205/67; 205/76; 205/81; 205/102; 204/230.2; 204/230.4

(58) Field of Search ..... 205/67, 76, 81, 205/102; 204/230.2, 230.4

(56) References Cited

U.S. PATENT DOCUMENTS 3,883,403 A * 5/1975 Ettel et al. ..... 205/76
4,100,036 A 7/1978 Rode et al.
4,490,218 A * 12/1984 Kadija et al. ..... 205/77
5,240,569 A 8/1993 Waldron
5,310,466 A 5/1994 La Riviere et al.

FOREIGN PATENT DOCUMENTS

| | | |
|---|---|---|
| DE | 3922959 | 12/1989 |
| EP | 0356516 | 3/1990 |
| FR | 2609850 | 7/1988 |
| WO | 0032846 | 6/2000 |

* cited by examiner

*Primary Examiner*—Wesley A. Nicolas
(74) *Attorney, Agent, or Firm*—Stevens, Davis, Miller & Mosher, LLP

(57) ABSTRACT

A method and apparatus for maintaining electro-deposition of metal on a cathode in an electrolytic cell. The cell comprises a metal anode, a cathode, an electrolytic bath and a main power supply to apply an electric potential across the anode and cathode resulting in a forward current and deposition of metal from said anode to the cathode. An auxiliary power supply is also provided for connection to the cell. In cases where the mains power supply falls below a predetermined value, the auxiliary power supply maintains a predetermined direction and quantity of current flow in the cell. The auxiliary power supply may be continuous or activated only when the current flow and/or direction of current falls below said predetermined value.

18 Claims, 5 Drawing Sheets

METHOD AND APPARATUS FOR ELECTRO-DEPOSITION OF METAL

TECHNICAL FIELD

The present invention relates to a method and apparatus for electro deposition of metal.

BACKGROUND ART

There are various processes and apparatus for electro-refining or electro-winning metal.

One particularly successful process for electro-depositing of copper for example is the so-called ISA PROCESS in which copper is deposited on a stainless steel cathode mother plate. The electrolytically deposited copper is then stripped from the cathode by first flexing the cathode to cause at least a part of the copper deposit to separate from the cathode and then wedge stripping or gas blasting the remainder of the copper from the cathode.

In the ISA PROCESS the bottom edge of the cathode mother plate is generally covered with a release compound such as wax or a plastic edge strip to prevent deposition of copper thereon. This allows for removal of the electro-deposited copper as substantially equivalent separate sheets from both sides of the cathode plate. Such waxing of the cathode sheet, however, is time consuming and there is added cost both for applying the wax and for recovering the wax from the stripping process and associated housekeeping.

To avoid these difficulties, some electro-refining/electro-winning operations use a so-called enveloped cathode process. In such a process the lower edge of the cathode sheet is not waxed and the electro-deposited metal is allowed to grow on both sides of the sheet and around the bottom edge of the cathode mother plate.

Removal of the electrolytically deposited envelope of metal is then accomplished by flexing the cathode and pulling back the metal from both sides of the sheet so that it forms a V. The cathode mother plate is then removed from between the electrolytically deposited envelope of metal, the envelope is then closed and rotated from its vertical position to a horizontal position and transported to a stacking/bundling station.

Not only does such a removal process require complex apparatus for opening the metal envelope, removing the cathode mother plate prior to closing of the envelope and rotating the envelope from the vertical to the horizontal position for stacking, such an arrangement is time consuming and generally not as quick as the ISA PROCESS stripping step.

In conjunction with others, the applicant has recently developed a new process in which an envelope of metal is formed on a stainless steel cathode mother plate and then stripped into two separate sheets. This process is subject of co-pending International Patent Application No. PCT/FI99/00979. By way of summary, this process will now be described with reference to FIGS. 1A–2D.

The initial step in stripping an electrolytically deposited metal envelope from its cathode mother sheet is to at least partially separate either side of the deposited envelope from the cathode sheet. In this regard, reference is made to FIGS. 1A–1D. The enveloped cathode comprises cathode sheets 20 and 30 deposited on the cathode mother sheet 10 and joined along the lower edge thereof by a frangible portion 40. The cathode mother sheet is firstly flexed to provide separation of at least the upper end portion 50 of the sheets 20, 30.

The partially separated envelope as shown in FIG. 1D is then subjected to a stripping operation as shown in FIGS. 2A–2D. The partially separate sheets 20 and 30 are positioned in a stripping apparatus on rollers or conveyor belt 50. The apparatus includes a wedge stripper or air blaster 130. These wedge strippers 130 enter the gap between sheets 20, 30 and cathode mother sheet 10. The wedge strippers 130 essentially separate the entire sheet portions 20 and 30 of the electrodeposited envelope from the cathode mother sheet 10. The sheets 20 and 30, however, are still held together by the frangible portion 40 extending along the bottom edge of the cathode sheet 10 as shown in FIG. 2B. To effect full separation of the electrodeposited metal envelope from the cathode mother sheet 10 into separate substantially equivalent sheets 20 and 30 is held by grippers 25, 35 and rotated about the frangible portion 40 from the substantial vertical position shown in FIG. 2B to the substantially horizontal position shown in FIG. 2C. This rotation separates the deposited metal from the cathode into two substantially equivalent sheets. In many cases, a single rotation of the sheets 20, 30 from the vertical to the horizontal is all that is required to separate the sheets. This separation of the sheets 20 and 20 from each other as well as the cathode mother plate may be confirmed by the grippers 25, 35 as follows. The grippers which still hold the sheet 20, 30 in horizontal position shown in FIG. 2C, are adapted to pull the respective sheets slightly outward as shown in FIG. 2D. If the sheets, 20, 30 move outwardly in unison with the grippers, separation of the sheets 20, 30 is confirmed. If, however, the force to move the grippers outward is too great or simply the grippers do not move this indicates that the frangible portion 40 has not in fact separated the sheets 20, 30 and accordingly further rotation (as shown in FIG. 2C) of the sheets may be required.

If further manipulation/rotation of sheets 20, 30 is required, the apparatus using grippers 25 and 35 rotates sheets 20 and 30 upwardly and downwardly until the aforementioned confirmation of separation of the sheets is effected.

In a preferred embodiment, cathode sheet 10 may be lifted upwardly in the stripping apparatus to provide more clearance between it and the sheets 20, 30 and frangible portion 40 since manipulation of the sheets 20 and 30 may cause contact between at least the frangible portion 40 and the cathode sheet 10.

Once the cathode sheets 20 and 30 are separated into substantially equivalent separate sheets, it is a simple matter to transport the sheets out of the apparatus for stacking and subsequent treatment.

The growth of this deposited metal envelope, however, is complex and the applicant has found that under certain process conditions it may be difficult to separate the electro-deposited envelope into two separate sheets. This is particularly true if, for any reason, power supplied to the electrolytic bath is interrupted for any substantial length of time. If this occurs, the metal sheets require rotating or flapping several times to effect separation.

It is an object of the present invention to overcome or ameliorate at least one of the disadvantages of the prior art, or to provide a useful alternative thereto.

DISCLOSURE OF THE INVENTION

In a first aspect, the present invention provides a method for electro depositing metal on a cathode in an electrolytic cell, said method comprising applying an electric potential to the cell to deposit an envelope of metal on said cathode, said envelope including two substantially equivalent sheets on either side of said cathode joined along at least one edge portion by a frangible region, the metal being removable from the cathode by rotation of the respective sheets about the frangible region, wherein the direction and quantity of current in the electrolytic cell is monitored such that as current flow approaches or reaches a predetermined value and/or the direction of current flow changes, an auxiliary power supply applies an auxiliary potential to the cell at a level sufficient to maintain a predetermined direction and quantity of current flow in the cell.

Not wishing to be bound by any particular theory, the present applicant has found that power interruption for any considerable period of time (ie. one hour or more) in the cell can result in "lamination" of the metal in the area of the frangible region. To explain, if power is supplied to the electrolytic cell resulting in a "forward" current, deposition of metal from the anode to the cathode is maintained and the metal is deposited in a controlled orderly fashion.

On the other hand, if power is interrupted and later recommenced, the orientation of metal deposition appears to alter. It is believed this is due to the metal treating the exterior surface of the already deposited metal as a fresh surface on which to deposit. Accordingly there may be several "directional" changes of deposited metal crystals in the area of the frangible region if power is interrupted on more than one occasion. This results in laminates of different crystal orientations appearing in the metal.

The boundary layers between such laminations can act as fault lines resulting in unpredictable and non-uniform separation of the deposited envelope of metal into two separate sheets. By maintaining a predetermined direction and quantity of current flow in the cell, the metal crystals deposit in a uniform and consistent matter thereby avoiding such laminates of different crystal orientations.

The auxiliary power supply may be activated during the entire period of metal growth on the cathode such that power never drops to below a predetermined level resulting in zero or backward current. Alternatively, the auxiliary power may be activated only when main power supply is reduced or fails.

In a further aspect, the present invention provides a method of providing power to an electrolytic cell to deposit metal on a cathode comprising providing a main power supply and an auxiliary power supply to the cell, the auxiliary power supply being sufficient to maintain a predetermined direction and quantity of current flow in the cell when activated.

In yet a further aspect, the present invention provides an apparatus for maintaining electro-deposition of metal on a cathode in an electrolytic cell, said electrolytic cell comprising a metal anode, a cathode, an electrolytic bath and a main power supply to apply an electric potential across the anode and cathode resulting a forward current and deposition of metal from said anode to said cathode, said apparatus including an auxiliary power supply adapted for connection to the cell such that in cases of mains power supply reduction or failure, said auxiliary power supply maintains a predetermined direction and quantity of current flow in the cell.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

BRIEF DESCRIPTION OF THE DRAWINGS

In an effort to more fully describe the present invention it will now be described, by way of example only, with reference to the accompanying drawings in which FIGS. 1A–2D are end elevational views of the process for stripping electro-deposited metal envelopes as developed by the applicant and are included for clarification purposes only.

BEST MODE FOR CARRYING OUT THE INVENTION

FIGS. 1A–2D have been discussed above.

Figures 1A, 1B, 1C, 1D:
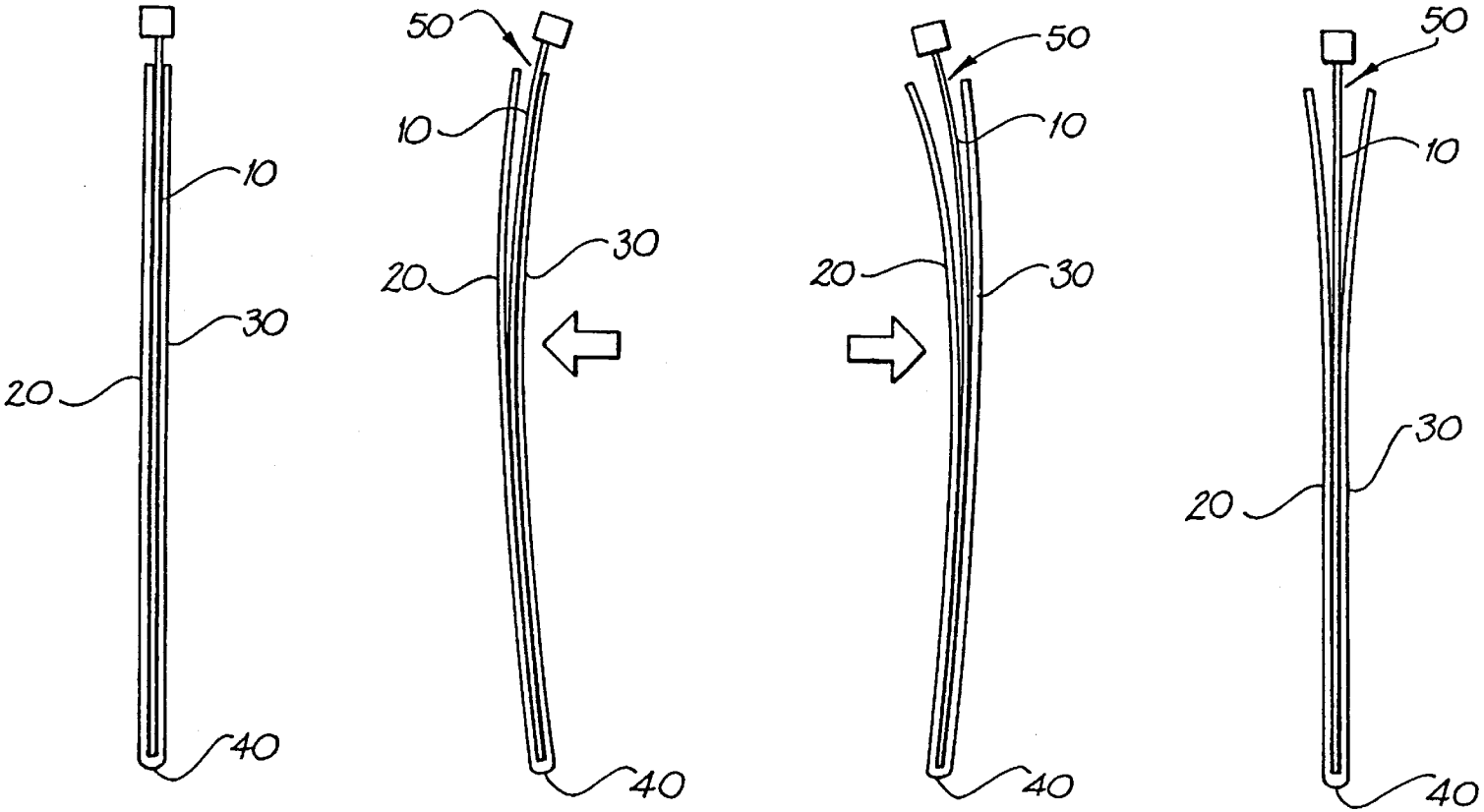
FIG. 1A PRIOR ART
FIG. 1B PRIOR ART
FIG. 1C PRIOR ART
FIG. 1D PRIOR ART
Figure 2B:
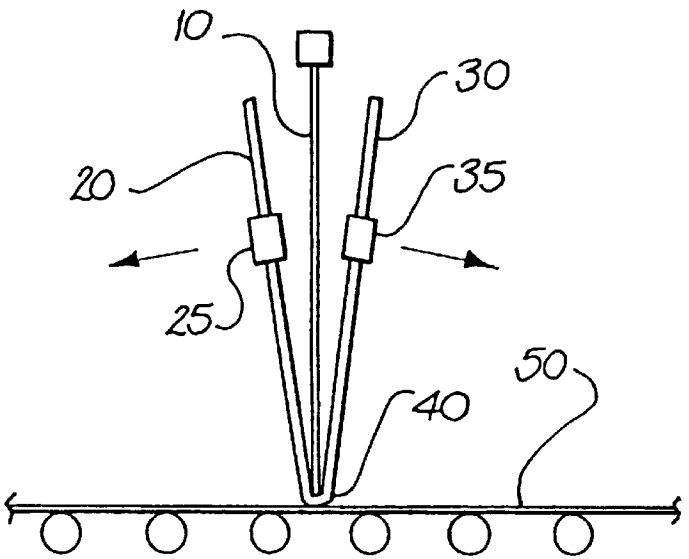
FIG. 2B PRIOR ART
Figure 2A:
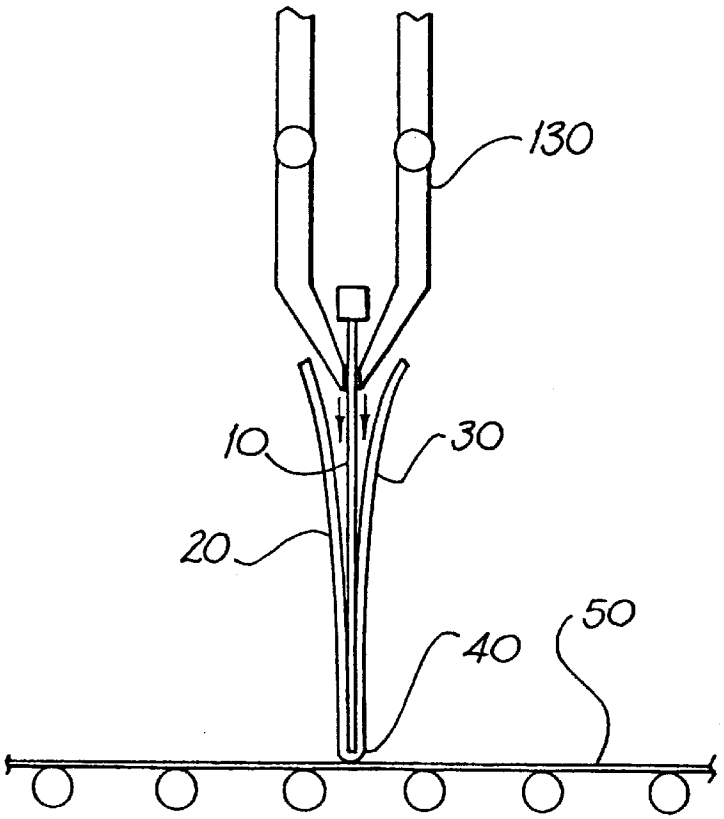
FIG. 2A PRIOR ART
Figure 2C:
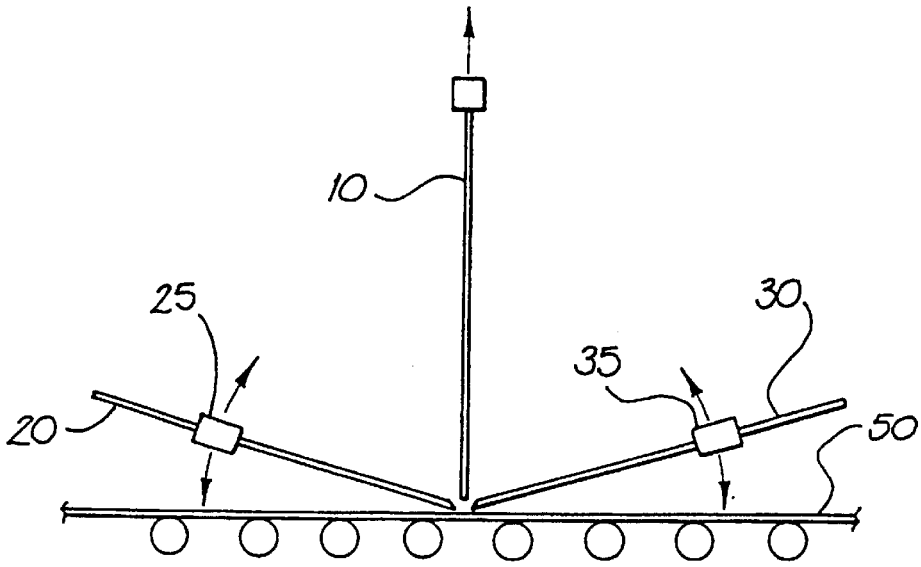
FIG. 2C PRIOR ART
Figure 2D:
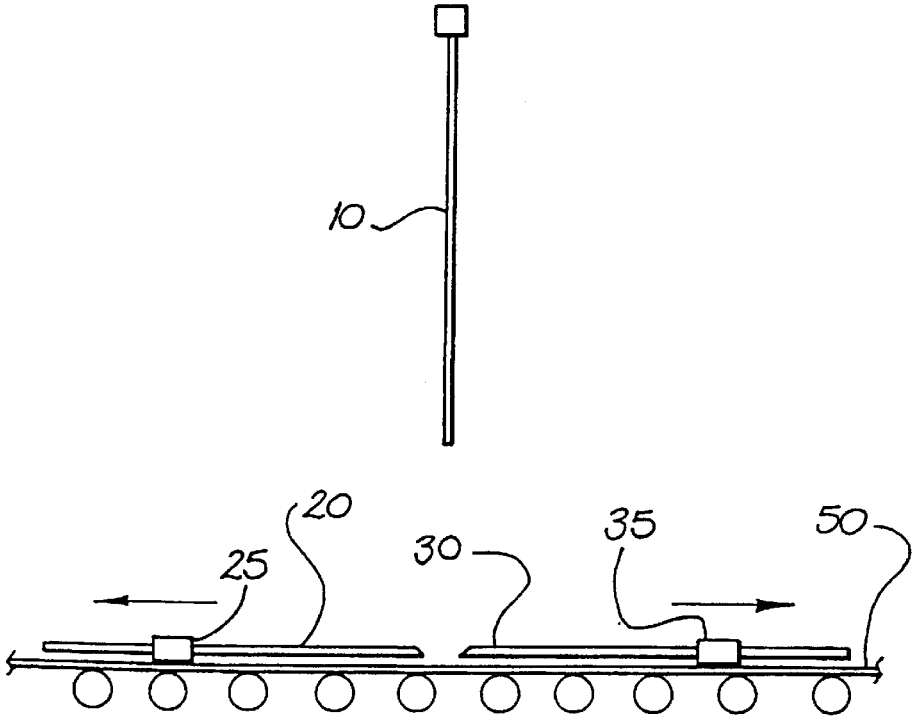
FIG. 2D PRIOR ART
Figure 3:
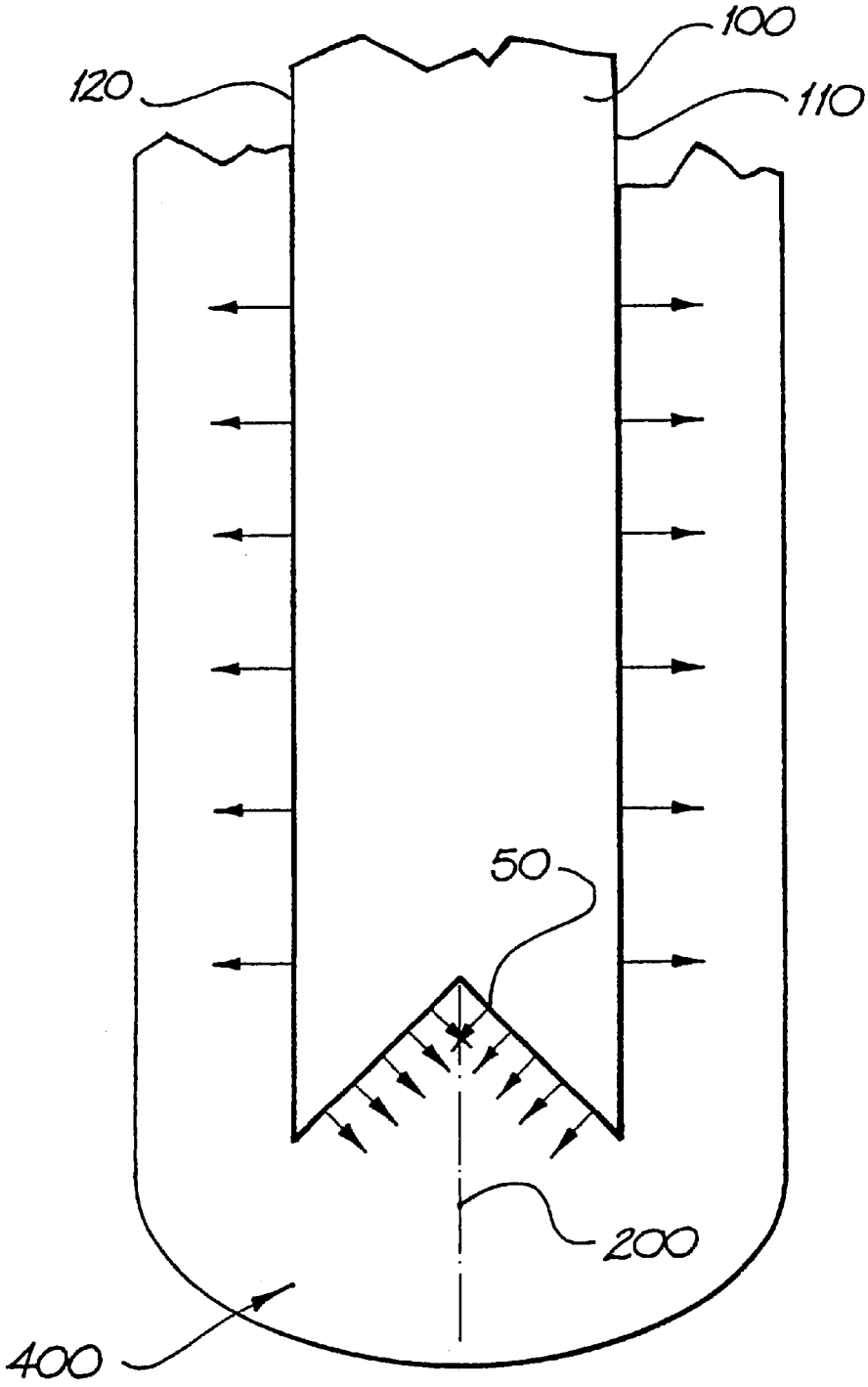
FIG. 3 is an end elevational view of a lower end of a cathode mother plate with electro deposited material thereon.

The invention will be described by way of example to electro-refining of metal e.g. copper, however, it will be appreciated that it may also be used in electro-winning of metal. Referring firstly to FIG. 3, by way of explanation it will be clear to persons skilled in the art that when cathode plate 100 is placed in an electrolytic bath and current is applied thereto, the metal in the anode eg. copper will dissolve into the electrolyte bath for re-deposition on the cathode mother plate 100. The crystals of metal seek to deposit and grow at right angles to the deposition surface as shown by the arrows. In this case, directly outward from sides of the plane 110 and 120 and, in V-groove 50, toward the plane of symmetry 200 of the cathode mother plate. If power is maintained, these directions of deposition generally continue. The plane of symmetry 200 in the V-groove 50 then forms a line of weakness where the copper crystals collide and this provides for reliable separation of the deposited metal envelope into two separate sheets.

Figure 5:
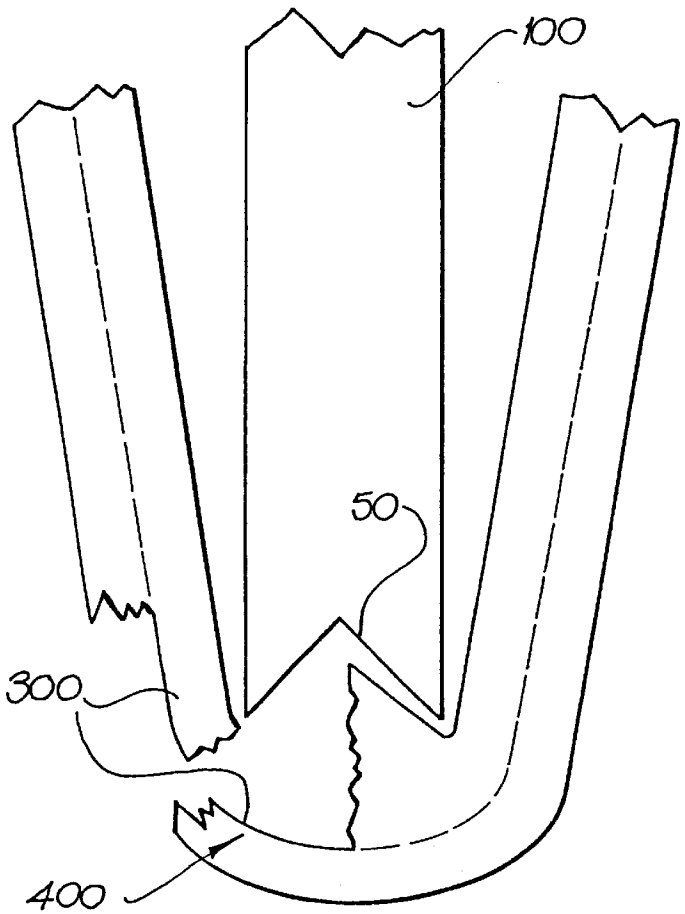
FIGS. 4 and 5 are similarly end elevational view of a cathode mother plate with electro deposited material thereon where there has been a power interruption.
Figure 4:
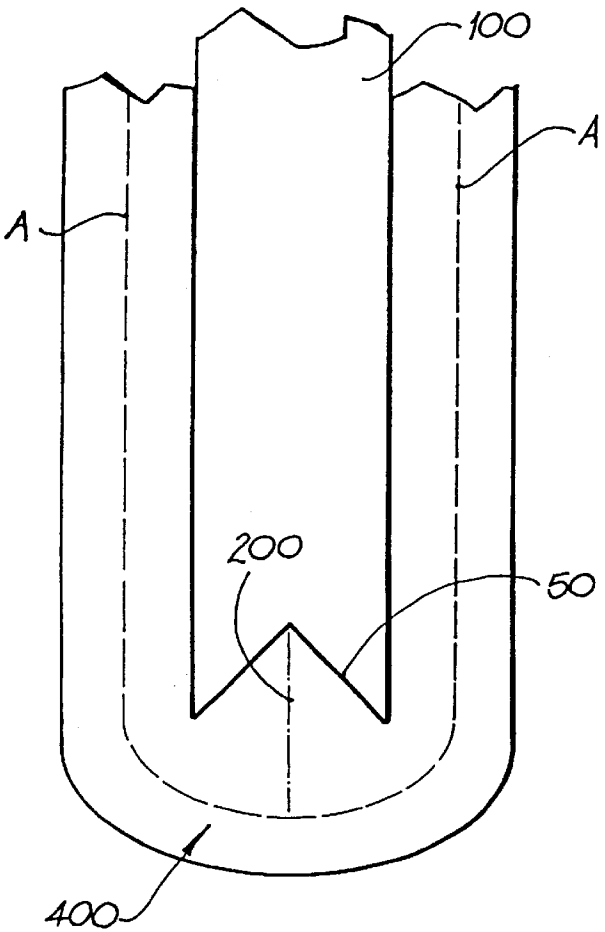

When, as shown in FIGS. 4 and 5, power to the cathode plate is interrupted, fault lines or laminations 300 form in and around the frangible region 400. To explain, if power is interrupted when the deposited metal envelope reaches dotted line A the deposited metal envelope up to that point is similar to that shown in FIG. 3 ie. consistent direction of metal deposits. If we now reapply power to obtain a forward current and recommence deposition, the metal crystals attempt to deposit at right angles to the surface A rather than following the previous direction of metal crystals i.e. a lamination of new copper 300 is laid over the previous metal.

It is believed that this "re-direction" of metal crystal growth or new laminated growth results in poor separability of the two metal sheets. This appears to be confirmed by the line of fracture by the two metal sheets as shown in FIG. 5. From testing done by the applicant, crack initiation begins similar to FIG. 3 ie. at or near the apex of the copper deposited in groove 50. This crack then follows the line of weakness 200 ie. where the two copper deposits grow to meet, and continues to move along this line until it reaches the point or layer of power interruption shown by dotted line A of the "new" growth. The line of weakness does not continue through this lamination. Accordingly, the fracture line of separation tends to branch off along the line of lamination A to locate the next weakest point and continue fracturing the two sheets. As we see in FIG. 5, this may result in a poor and unsightly separation of the two metal sheets. It also generally results in repeating the rotation/flapping cycle in the stripping machine, until the fracture is complete.

The applicant has found, however, that this lamination problem can be overcome by providing a trickle current through the electrolytic cells. An auxiliary power supply can be activated in times of low main power or power failure. The auxiliary power supply should be sufficient to simply maintain a forward current of flow. It is not necessary for the auxiliary power supply to result in a current sufficient to continue deposition of the metal. It is simply sufficient that a forward current be provided in the electrolytic cell.

Preferably, the auxiliary power supply is variable such that when it is activated, current across the cell can be monitored to determine whether a forward current is occurring. The auxiliary power supply may then be increased until the point at which a minimal trickle forward current is monitored in the cell.

While not wishing to be down by any particular theory in this regard, the applicant believes that such a minimal forward trickle current not only prevents re-dissolution of the copper from the cathode back into the electrolytic bath but further it prevents deposition of contaminants onto the face of the deposited metal and maintains orientation of the crystal structure. In other words, when full power is then resupplied, the deposited metal continues its previous orientation of deposition rather than treating the already deposited metal as a fresh surface on which to deposit.

The application of the auxiliary power may also be altered during the residence time of the cathode in the electrolytic cell.

Generally if power outage or reduction occurs in the first or second day of growth, the size and shape of the groove 50 and the metal deposited therein tends to overrides any lamination effect. If, however, power failure occurs say in the 3–4 day period there is a lower probability of lamination problems occurring however the severity of those problems is greatly increased.

Later in the growth, eg. day 6 and 7, if power failure occurs the frequency of the aforementioned lamination problems is increased however its severity is slightly less.

Accordingly, it can be seen that provision of an appropriate auxiliary power supply to maintain a forward current in the electrolytic cells overcomes or at least reduces potential problems caused by power failure to the cells.

It will be appreciated that variations to the described process and apparatus may be made without departing from the spirit or scope of the present invention.

What is claimed is:

1. A method for electro depositing metal on a cathode in an electrolytic cell, said method comprising applying an electric potential to the cell to deposit an envelope of metal on said cathode, said envelope including two substantially equivalent sheets on either side of said cathode joined along at least one edge portion by a frangible region, the metal being removable from the cathode by rotation of the respective sheets about the frangible region, wherein the direction and quantity of current in the electrolytic cell is monitored such that as current flow or direction of current approaches or reaches a predetermined value and/or the direction of current flow changes, an auxiliary power supply applies an auxiliary potential to the cell at a level sufficient to maintain a predetermined direction and quantity of current flow in the cell.

2. A method as claimed in claim 1 wherein said auxiliary power supply is activated during the entire period of metal deposition on the cathode such that the current flow or direction never drops below said predetermined value.

3. A method for electro depositing metal on a cathode in an electrolytic cell, said method comprising applying an electric potential to the cell to deposit an envelope of metal on said cathode, said envelope including two substantially equivalent sheets on either side of said cathode joined along at least one edge portion by a frangible region, the metal being removable from the cathode by rotation of the respective sheets about the frangible region, wherein the direction and quantity of current in the electrolytic cell is monitored such that as current flow or direction of current approaches or reaches a predetermined value and/or the direction of current flow changes, an auxiliary power supply applies an auxiliary potential to the cell at a level sufficient to maintain a predetermined direction and quantity of current flow in the cell, and wherein the auxiliary power supply is activated only when the current flow and/or direction of current reaches said predetermined value.

4. A method of providing power to an electrolytic cell to deposit metal on a cathode comprising providing a main power supply and an auxiliary power supply to the cell, the auxiliary power supply being sufficient to maintain a predetermined direction and quantity of current flow in the cell when activated.

5. A method as claimed in claim 4 wherein said auxiliary power supply is activated during the entire period of metal deposition on the cathode such that the current flow or direction never drops below said predetermined direction and quantity.

6. A method of providing power to an electrolytic cell to deposit metal on a cathode comprising providing a main power supply and an auxiliary power supply to the cell, the auxiliary power supply being sufficient to maintain a predetermined direction and quantity of current flow in the cell when activated, wherein the auxiliary power supply is activated only when the current flow and/or direction of current reaches said predetermined direction and quantity.

7. An apparatus for maintaining electro-deposition of metal on a cathode in an electrolytic cell, said electrolytic cell comprising a metal anode, a cathode, an electrolytic bath and a main power supply to apply an electric potential across the anode and cathode resulting a forward current and deposition of metal from said anode to said cathode, said apparatus including an auxiliary power supply adapted for connection to the cell such that in cases of main power supply reduction or failure, said auxiliary power supply maintains a predetermined direction and quantity of current flow in the cell.

8. An apparatus as claimed in claim 7 wherein said auxiliary power supply is adapted to supply power during the entire period of metal deposition on the cathode such that the current flow never drops below said predetermined direction and quantity.

9. An apparatus for maintaining electro-deposition of metal an a cathode in an electrolytic cell, said electrolytic cell comprising a metal anode, a cathode, an electrolytic bath and a main power supply to apply an electric potential across the anode and cathode resulting a forward current and deposition of metal from said anode to said cathode, said apparatus including an auxiliary power supply adapted for connection to the cell such that in cases of main power supply reduction or failure, said auxiliary power supply maintains a predetermined direction and quantity of current flow in the cell, wherein the auxiliary power supply is adapted to be activated only when the current flow and/or the direction of current reaches said predetermined direction and quantity.

10. A method as claimed in claim 1, wherein power across the cell is drawn from a main power supply to apply the electric potential sufficient to deposit metal onto said cathode and the auxiliary power supply assists the main power supply to maintain at least the predetermined value in the cell.

11. A method as claimed in claim 10, wherein the auxiliary power supply assists the main power supply when the main power supply is unable to supply on its own the predetermined value.

12. A method as claimed in claim 10, wherein the auxiliary power supplies power to the cell when the main power supply provides no power to the cell.

13. A method as claimed in claim 10, wherein the predetermined value in the cell is a trickle current through the cell sufficient to maintain forward current in the cell.

14. A method as claimed in claim 4, wherein the main power supply provides power across the cell sufficient to deposit metal onto said cathode and the auxiliary power supply assists the main power supply to maintain at least the predetermined direction and quantity of current flow in the cell.

15. A method as claimed in claim 14, wherein the auxiliary power supply assists the main power supply when the main power supply is unable to supply on its own the predetermined direction and quantity of current flow in the cell.

16. A method as claimed in claim 14, wherein the auxiliary power supplies power to the cell when the main power supply provides no power to the cell.

17. A method as claimed in claim 14, wherein the predetermined direction and quantity of current flow in the cell is a trickle current through the cell sufficient to maintain forward current in the cell.

18. A method as claimed in claim 7, wherein the predetermined value in the cell is a trickle current through the cell sufficient to maintain forward current in the cell.

* * * * *